US008251553B2

(12) United States Patent
Dantas

(10) Patent No.: US 8,251,553 B2
(45) Date of Patent: Aug. 28, 2012

(54) VEHICLE LIFT SYSTEMS WITH LIGHTING

(75) Inventor: Roy J. Dantas, Scarborough (CA)

(73) Assignee: Snap-On Tools of Canada, Ltd., Mississauga (CA)

( * ) Notice: Subject to any disclaimer, the term of this patent is extended or adjusted under 35 U.S.C. 154(b) by 165 days.

(21) Appl. No.: 12/881,333

(22) Filed: Sep. 14, 2010

(65) Prior Publication Data

US 2011/0063859 A1 Mar. 17, 2011

Related U.S. Application Data

(60) Provisional application No. 61/242,260, filed on Sep. 14, 2009.

(51) Int. Cl.
*F21V 19/00* (2006.01)
*F21V 21/00* (2006.01)

(52) U.S. Cl. ..... 362/382; 362/253; 362/458; 362/487; 187/203

(58) Field of Classification Search ..... 362/253, 362/382, 384–386, 458, 487; 187/203–221
See application file for complete search history.

(56) References Cited

U.S. PATENT DOCUMENTS

| | | | |
|---|---|---|---|
| 1,859,349 | A | 5/1932 | Thibodeaux |
| 5,675,515 | A | 10/1997 | January |
| 7,308,971 | B2 | 12/2007 | Liebetreu et al. |

FOREIGN PATENT DOCUMENTS

| | | | |
|---|---|---|---|
| GB | 451563 | A | 8/1936 |
| GB | 703090 | A | 1/1954 |
| JP | 4371499 | A | 12/1992 |
| JP | 2005170519 | A | 6/2005 |

OTHER PUBLICATIONS

English Abstract of JP Application No. 2005170519 to Kii et al.
English Abstract of JP Application No. 4371499 to Komorida et al.

*Primary Examiner* — Jason Moon Han
(74) *Attorney, Agent, or Firm* — Bereskin & Parr LLP/S.E.N.C.R.L., s.r.

(57) ABSTRACT

A vehicle lift system includes a support structure having a top surface for supporting a vehicle supported by the vehicle lift system, and at least one lighting module. The lighting module is mounted to the top surface of the support structure. The lighting module is configured to illuminate a region of the vehicle, for example, but not limited to, the underside of the vehicle. The lighting module can be mounted generally flush relative to the top surface of the support structure. In a vehicle wheel alignment lift system, the lighting module can be disposed adjacent a movable support surface of the wheel runway apparatus to provide illumination during wheel alignment procedures.

16 Claims, 6 Drawing Sheets

VEHICLE LIFT SYSTEMS WITH LIGHTING

This application claims the benefit of U.S. Provisional Application No. 61/242,260 filed Sep. 14, 2009, and the entire contents of which are hereby incorporated by reference.

FIELD

This specification relates to vehicle lift systems. This specification also relates to vehicle wheel alignment systems.

BACKGROUND

The following paragraphs are not an admission that anything discussed in them is prior art or part of the knowledge of persons skilled in the art.

Servicing of vehicles, including conducting alignment procedures, can require precision mechanical adjustments underneath the vehicle, which in turn may necessitate lighting. Portable lighting fixtures may diminish the mechanic's productivity, for example, but not limited to, such fixtures can require frequent recharging when battery operated, and/or can pose safety threats when corded.

INTRODUCTION

In an aspect of this specification, a vehicle lift system can include: a support structure including a top surface for supporting a vehicle supported by the vehicle lift system, and at least one lighting module mounted to the top surface of the support structure, the lighting module configured to illuminate a region of the vehicle, for example, but not limited to, display lighting or the underside of the vehicle.

In an aspect of this specification, the vehicle lift system can include a support structure including first and second ends and a length extending between the first and second ends defining a longitudinal direction, and a top surface for supporting wheels of a vehicle supported by the vehicle lift system; a movable support surface associated with the fixed wheels of the vehicle and located towards the first end of the support structure; and at least one lighting module mounted to the movable support surface, the lighting module extending generally in the longitudinal direction adjacent the movable support surface generally between the movable support surface and the inner side of the support structure, the lighting module configured to illuminate an underside region of the vehicle.

In an aspect of this specification, a turntable apparatus for a vehicle lift system can, include: a base including a top surface and an inner side; a movable support surface mounted on the base for supporting wheels of a vehicle supported by the vehicle lift system; and at least one lighting module mounted to the top surface of the base, the lighting module extending adjacent the movable support surface generally between the movable support surface and the inner side of the base, the lighting module configured to illuminate an underside region of the vehicle.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
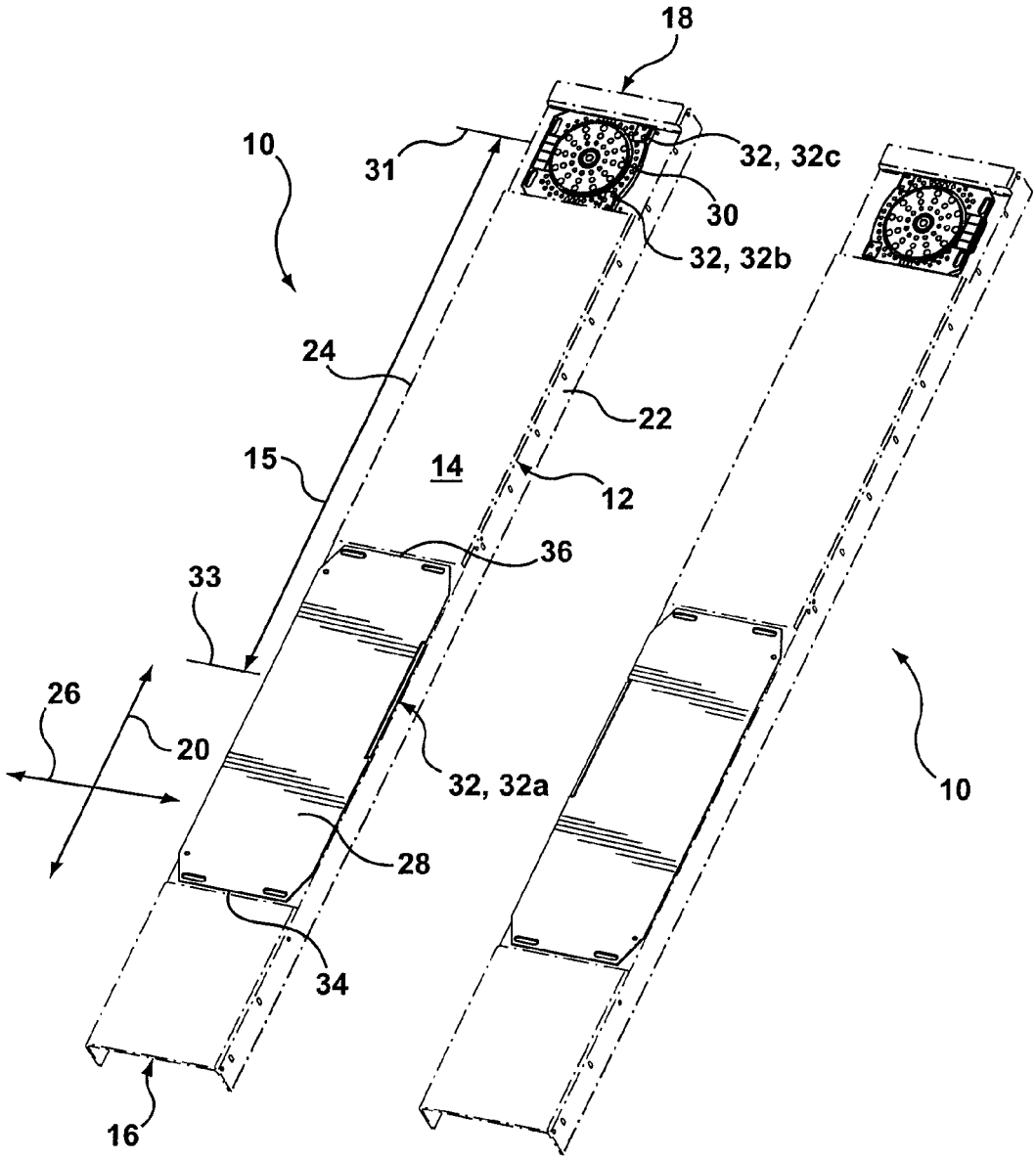
FIG. 1 shows a top perspective view of a pair of wheel runway apparatuses having movable support surfaces and lighting modules.

Referring to FIG. 1, a wheel runway apparatus for a vehicle lift system is shown generally at 10. The wheel runway apparatus 10 can be utilized in various vehicle lift systems, including but not limited to four-post lift systems and scissor lift systems.

The wheel runway apparatus 10 includes a support structure 12. The support structure 12 includes a top surface 14 for supporting a vehicle, and for the embodiment illustrated, but not limited to, supporting the wheels of the vehicle. The support structure 12 includes first and second ends 16, 18, and a length extending between the first and second ends 16, 18 defining a longitudinal direction 20. The support structure 12 further includes inner and outer sides 22, 24, and a width extending between the inner and outer sides 22, 24 defining a lateral direction 26.

The wheel runway apparatus 10 includes at least one lighting module 32. The lighting module 32 is mounted to the top surface 14 of the support structure 12. For the embodiment illustrated, but not limited to that, the lighting module 32 can be mounted generally flush relative to the top surface 14 of the support structure 12. The lighting module 32 can extend adjacent the inner side 22 of the support structure 12. The lighting module 32 is configured to illuminate the vehicle when the vehicle is parked on the wheel runway apparatus 10, for example, but not limited to illuminating an underside region of the vehicle. The lighting module 32 is configured to provide illumination directed generally upwards towards parts of the vehicle that require servicing, and generally not in the mechanic's eyes. The lighting module can also be used for display lighting when the vehicle is on the lift.

In a vehicle wheel alignment lift system, the lighting module 32 can be disposed adjacent a movable support surface of the wheel runway apparatus to provide illumination during wheel alignment procedures.

In some examples, when implemented in a vehicle wheel alignment system, the wheel runway apparatus 10 can include a first movable support surface 28. The first movable support surface 28 can be located towards the first end 16 of the support structure 12, and can be referred to as a "slip plate." The first movable support surface 28 can be a generally rectangular plate mounted on a bearing surface (not shown), generally flush with the top surface 14 of the support structure 12. The first movable support surface 28 can permit limited motion of the fixed or rear wheels of the vehicle in a horizontal plane, at least in the lateral direction 26, relative to the support structure 12.

In some examples, when implemented in a vehicle wheel alignment system, the wheel runway apparatus 10 can include a second movable support surface 30. The second movable support surface 30 can be located towards the second end 18 of the support structure 12, and can be referred to as a "turn plate" or a "turntable." The second movable support surface 30 can be a generally round plate mounted on a bearing surface (not shown), generally flush with the top surface 14 of the support structure 12. The second movable support surface 30 can permit the steered or front wheels of a vehicle to be steered from side to side without requiring lifting of the vehicle, and simultaneously permit rotational motion and limited motion in a horizontal plane, in the longitudinal and lateral directions, 20, 26, relative to the support structure 12.

In some examples, the lighting module 32 includes an assembly or plurality of light emitting diodes. The light emitting diodes can be high intensity and low voltage. The light emitting diodes can provide better lighting of the work area and may increase reliability of lighting. Furthermore, use of an assembly or plurality of light emitting diodes may reduce or substantially eliminate shadow effects in the work area. In some examples the lighting module 32 can also include fiber optics. Further combinations of fiber optics and light emitting diodes can be provided for some applications.

Figure 2:
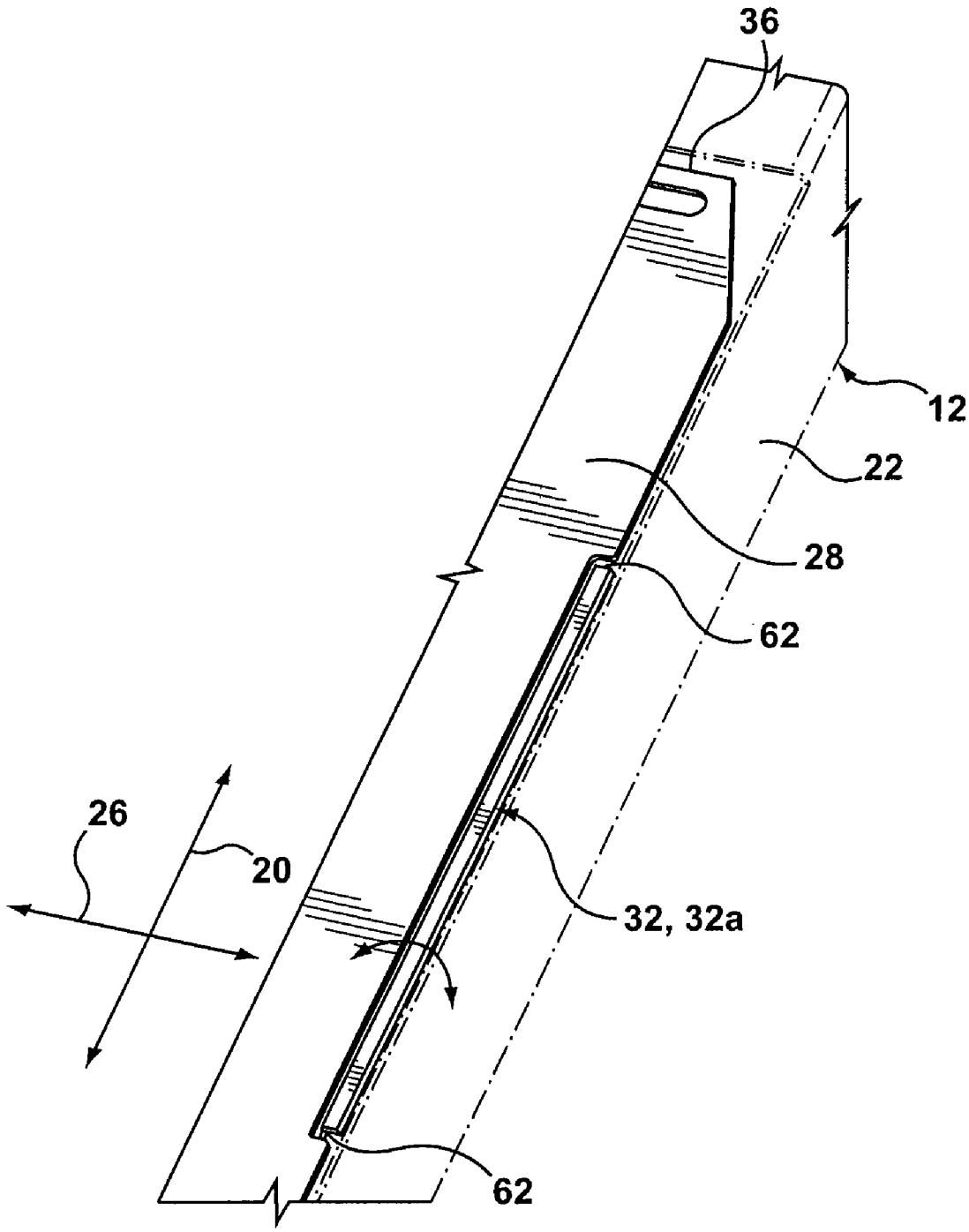
FIG. 2 shows a detailed perspective view of a lighting module adjacent a first movable support surface.

Referring to FIG. 2, the lighting module 32*a* can be disposed extending adjacent the first movable support surface 28, generally between the first movable support surface 28 and the inner side 22 of the support structure 12. The lighting module 32*a* can be elongate and extend generally in the longitudinal direction 20. The lighting module 32*a* can be mounted generally flush relative to the first movable support surface 28, and integrated either to the first movable support surface 28 or to the support structure 12.

Referring to FIG. 1, the lighting module 32*a* can be offset or spaced apart in the longitudinal direction 20 relative to first and second ends 34, 36 of the first movable support surface 28. In some particular examples, the first movable support surface 28 can have a dimension in the longitudinal direction 20 of about 72 inches, and the lighting module 32*a* can have a dimension in the longitudinal direction 20 of about 24 inches. A distance 15 between a centerline 31 of the second movable support surface 30 and a centerline 33 of the lighting module 32*a* can be selected to be between 100 to 120 inches in order to accommodate and provide optimal illumination for most vehicles.

The lighting module 32*a* can be pivotally mounted, either to the support structure 12 or the first movable support surface 28, so that the lighting module 32*a* is pivotable generally about the longitudinal direction 20. Pivoting allows the illumination provided by the lighting module 32*a* to be directed as desired by the mechanic. In some examples, referring to FIG. 2, the lighting module 32*a* can be pivotally mounted to the first support structure 12 with hinges 62.

Figure 3:
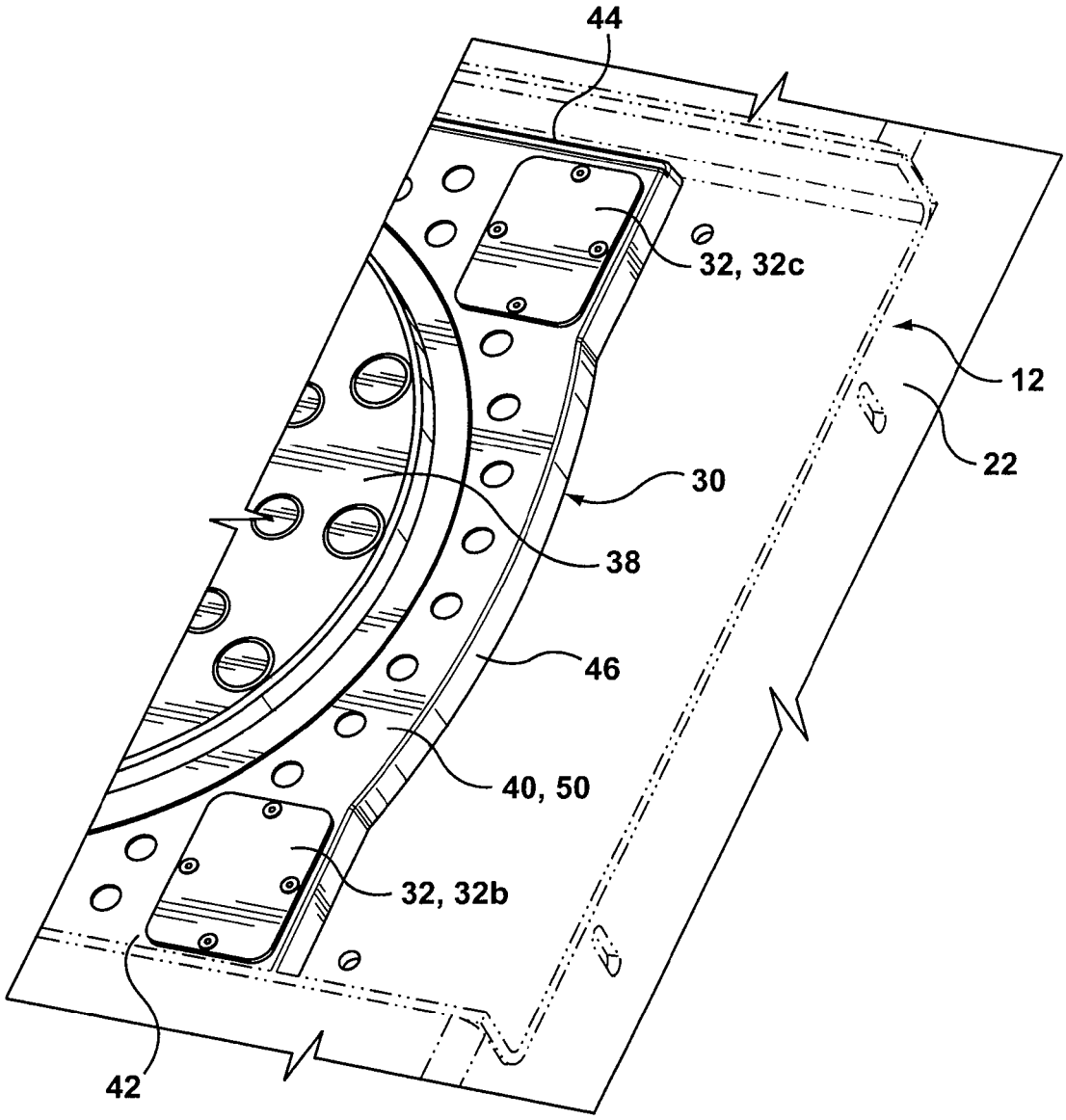
FIG. 3 shows a detailed perspective view of lighting modules adjacent a second movable support surface.
Figure 4:
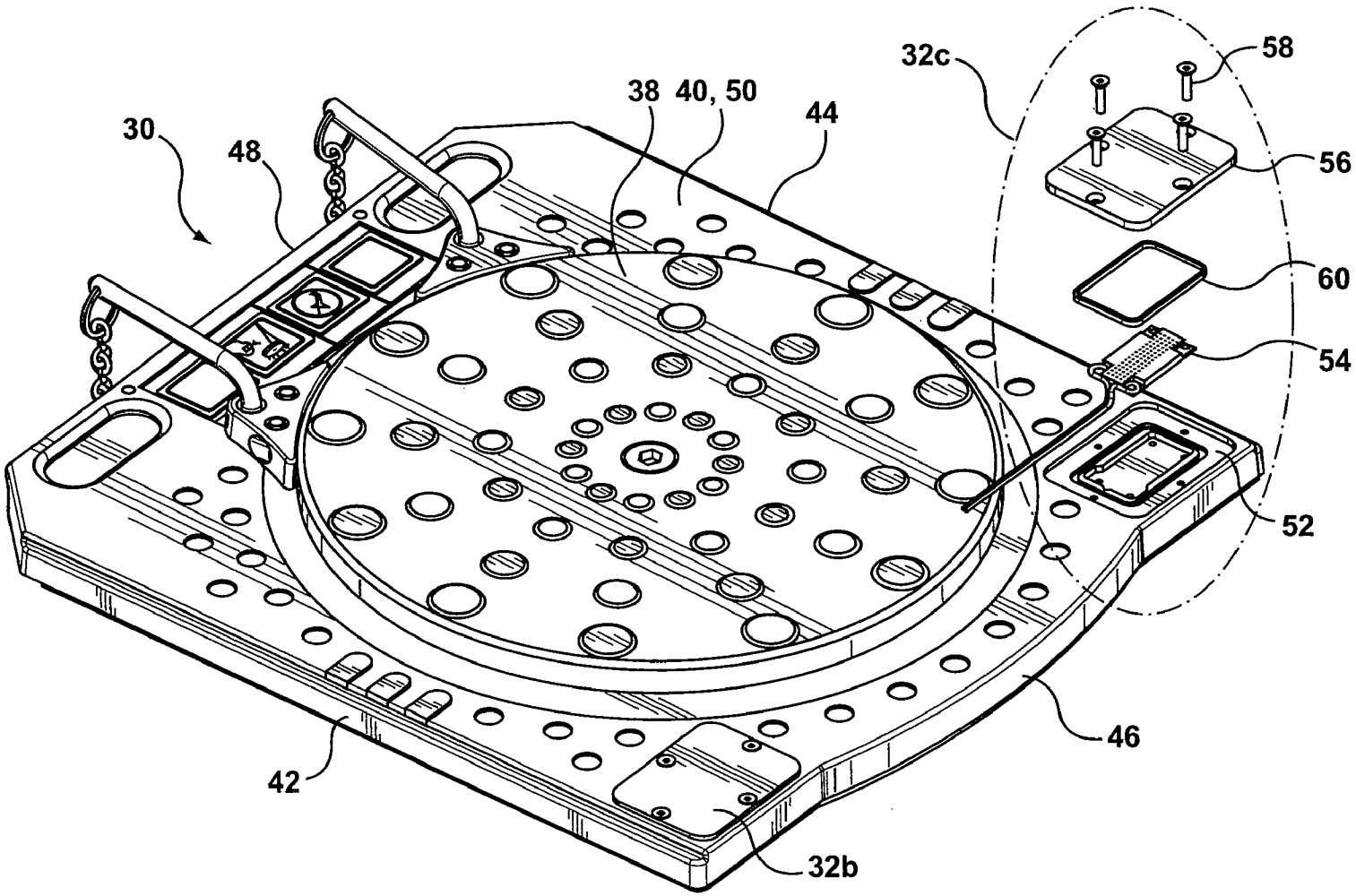
FIG. 4 shows a detailed, partially exploded perspective view of a lighting module adjacent the second movable support surface.

Referring to FIGS. 3 and 4, the lighting modules 32*b*, 32*c* can be disposed extending adjacent the second movable support surface 30 generally between the second movable support surface 30 and the inner side 22 of the support structure 14.

The second movable support surface 30 can include a turn plate 38 movably mounted to a base 40. The base 40 can include a front side 42, a rear side 44, an inner side 46, an outer side 48, and a top surface 50. The front side 42 can be oriented towards the first end 16 of the support structure 12, and the rear side 44 can be oriented towards the second end 18 of the support structure 12 (see FIG. 1). In some examples, the base 40 can be moveable in the lateral direction 26 relative to the support structure 12 in order to accommodate vehicles of different widths between the front wheels.

As illustrated, two of the lighting modules 32*b*, 32*c* can be mounted to the top surface 50 of the base 40. The lighting module 32*b* can be mounted adjacent to the front and inner sides 42, 46. The lighting module 32*c* can be mounted adjacent to the rear and inner sides 44, 46. The lighting modules 32*b*, 32*c* can be mounted generally flush relative to the top surface 50 of the base 40, and integrated therein. Positioned in spaced apart locations, the lighting modules 32*b*, 32*c* can provide generally complete illumination of the steered wheels as they are rotated from side to side during wheel alignment procedures.

Referring to FIG. 4, the base 40 can include a recess portion 52 for receiving the lighting module 32*c* mounted therein. As shown in the example of FIG. 4, the lighting module 32*c* can include an assembly of light emitting diodes 54. It can be appreciated that the illustrated example is not limited to light emitting diodes, and can include other light sources, such as, for example, fiber optics. The base 40 can serve as a heat sink for the light emitting diodes 54.

The lighting module 32*c* can include a protective outer cover 56, which can be a rigid transparent or translucent member, for example, a scratch-resistant plastic lens. The protective outer cover 56 can be generally flush relative to the top surface 50 of the base 40, and retained by screws 58. The lighting module 32*c* can include a sealing ring 60 disposed between the recess portion 52 of the base 40 and the protective outer cover 56.

Alternatively, the protective outer cover can consist of a potting compound (not shown), which can be applied to embed the assembly of light emitting diodes 54 and retain it in the recess portion 52 of the base 40. The potting compound can be selected to have relatively high transparency and scratch resistance, once hardened/cured.

The lighting module 32 can be remotely controlled. For example, the lighting module 32 can be selectively activated through a switch or control provided on the main lift system console (not shown). Alternatively or additionally, the lighting module 32 can be selectively activated through a switch provided on the lift system itself, whether on the support structure 12 or another area that is readily accessible by the mechanic.

Figures 5A, 5B:
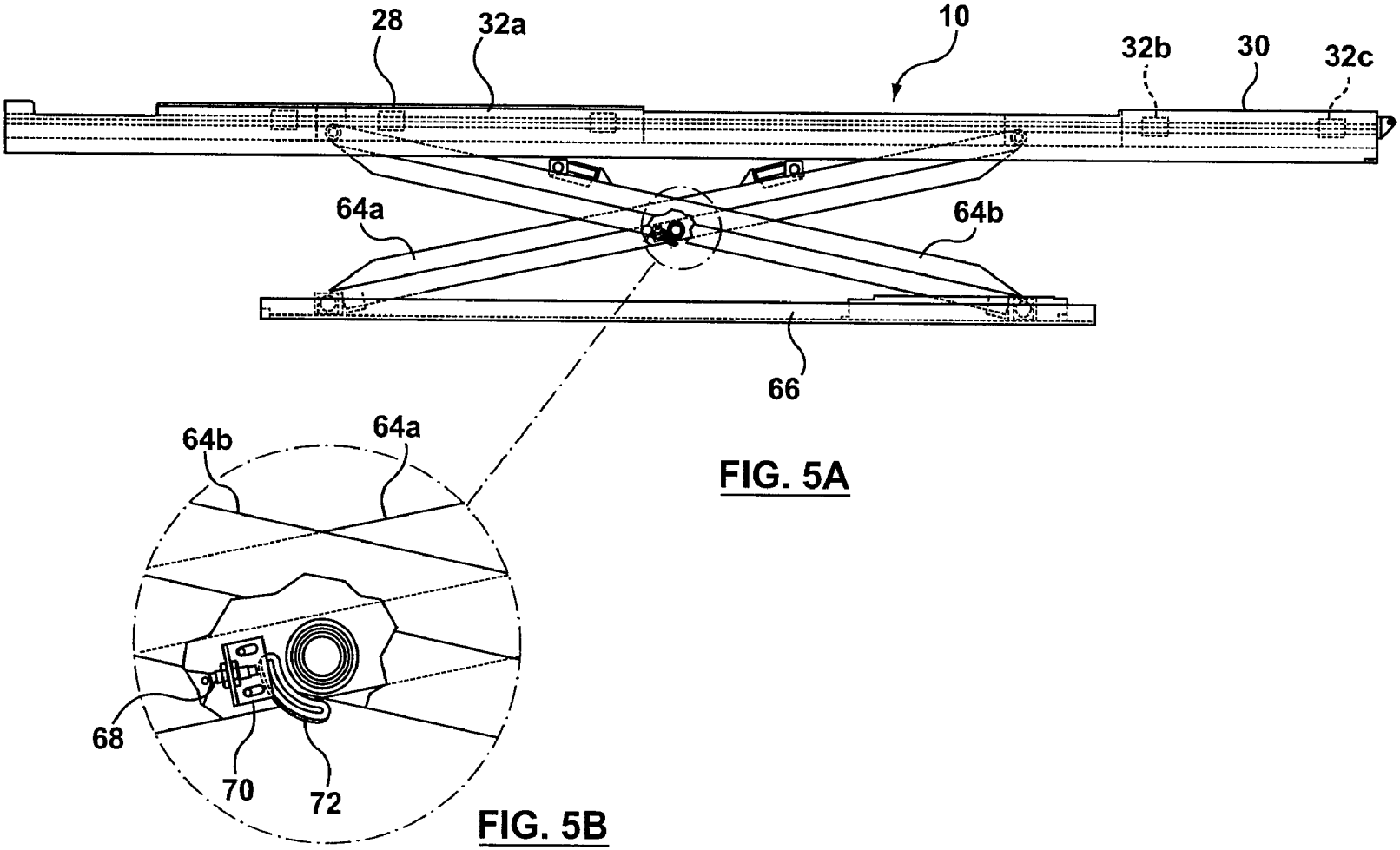
FIGS. 5A and 5B are side and detailed views of a wheel runway apparatus on a scissor lift, respectively.

The lighting module 32 may also be subject to automatic shutoff. Referring to FIGS. 5A and 5B, the wheel runway apparatus 10 is shown supported on a scissor lift including scissor members 64*a*, 64*b* and base 66. A pneumatic limit switch 68 (for example, FESTO™ model no. 12146) is mounted to the scissor member 64*a* using bracket 70. A cam member 72 is mounted to the scissor member 64*b* and is positioned such that it signals when the wheel runway apparatus 10 is at a set height from the floor, for example, about 18" or 20"

Figure 6:
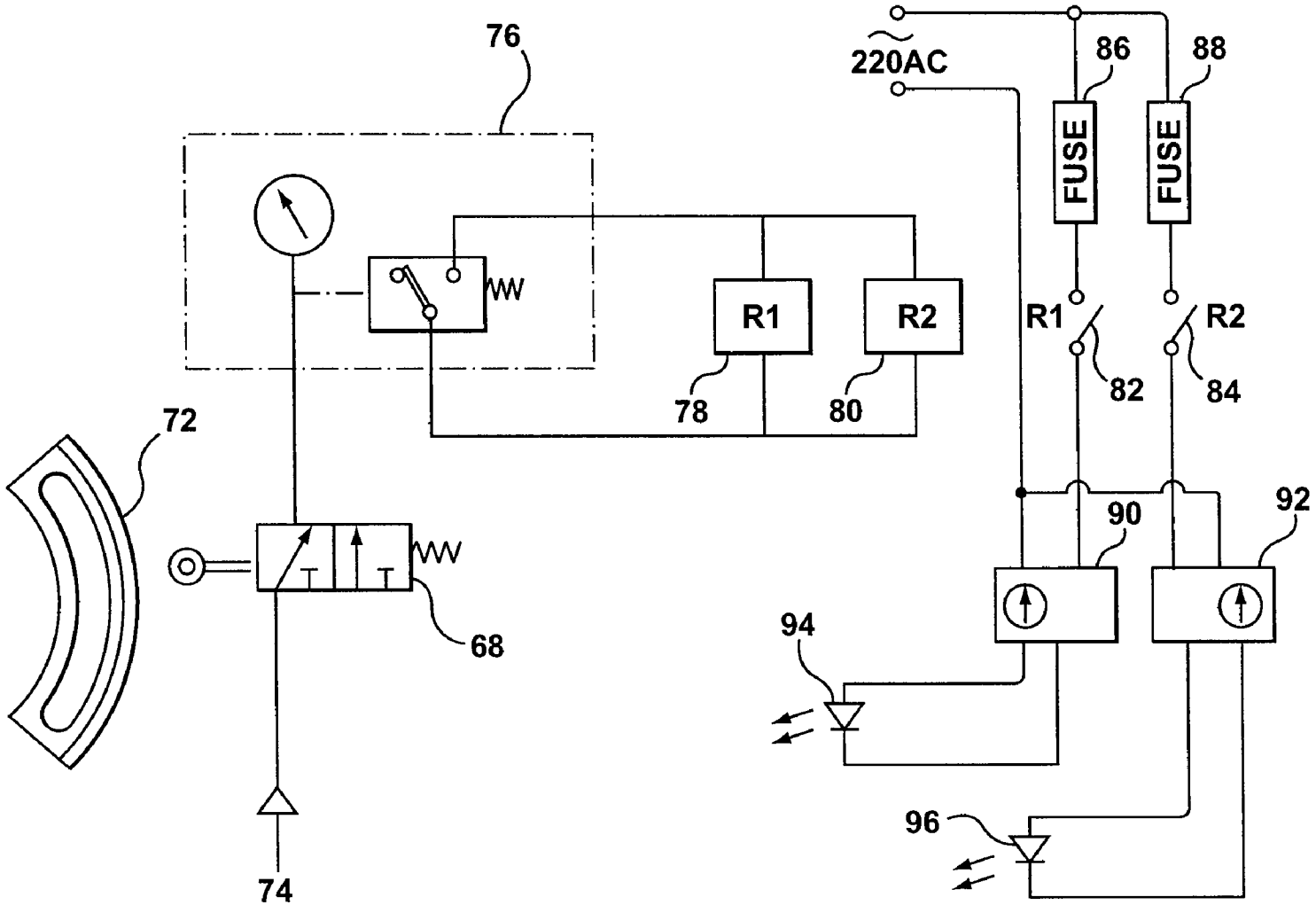
FIG. 6 is a pneumatic/electrical schematic diagram.

Also referring to FIG. 6, an air supply 74 can be provided to the limit switch 68. A pneumatic signal from the limit switch 68 can be transformed to an electrical signal by a gauge/switch 76 (for example, SMC™ model no. GP46-P10-N01M-X30). The gauge/switch 76 can be connected to relays 78, 80. The relays 78, 80 can connect AC power to drivers 90, 92 (for example, MAGTECH™ model no. LP1025-36C0700). Fuses 86, 88 can be provided to interrupt power supplied to the drivers 90, 92. The driver 90 can provide power for LED units 94 (for example, BIVAR™ model no. DLC1333) suitable for lighting module 32*a*. The driver 92 can provide power for LED units 96 (for example, LED-BRT™ model no. BWL-8C5A21) suitable for lighting modules 32*b*, 32*c*.

When the wheel runway apparatus 10 is at the set height or above, the light modules 32*a*, 32*b*, 32*c* are maintained "ON." When the wheel runway apparatus 10 is below the set height, the light modules 32*a*, 32*b*, 32*c* are automatically turned "OFF" for safety reasons.

Although this specification describes wheel runway apparatuses used in vehicle lift systems particularly in the context of alignment measurement, it should be appreciated that other applications of the teachings herein are contemplated. The teachings herein may be applied to other vehicle lift system configurations.

While the above description provides examples of one or more processes or apparatuses, it will be appreciated that other processes or apparatuses may be within the scope of the accompanying claims.

I claim:

1. A vehicle lift system, comprising:

a) a support structure including a top surface for supporting a vehicle, wherein the support structure includes a second turntable movable support surface associated with the steered wheels of the vehicle, the second movable support surface located towards a second end of the support structure;

b) at least one lighting module mounted to the top surface of the support structure, the lighting module configured to illuminate a region of the vehicle; and c) a second lighting module is mounted in a recess portion provided on a base of the second movable support surface.

2. The apparatus of claim 1, wherein the at least one lighting module extends adjacent an inner side of the support structure.

3. The apparatus of claim 1, wherein the at least one lighting module is mounted generally flush relative to the top surface of the support structure.

4. The apparatus of claim 1, wherein the support structure includes a first movable support surface associated with the fixed wheels of a vehicle, the movable support surface located towards a first end of the support structure.

5. The apparatus of claim 4, wherein the at least one lighting module extends adjacent the first movable support surface and generally between the first movable support surface and an inner side of the support structure.

6. The apparatus of claim 5, wherein the at least one lighting module is elongate and extends generally in a longitudinal direction.

7. The apparatus of claim 6, wherein the at least one lighting module is pivotable generally about the longitudinal direction.

8. The apparatus of claim 1, wherein the lighting module extends adjacent the second movable support surface and generally between the second movable support surface and the inner side of the support structure.

9. The apparatus of claim 1, wherein the at least one lighting module includes a protective cover.

10. The apparatus of claim 9, wherein the protective cover is generally flush relative to a top surface of the base.

11. The apparatus of claim 9, wherein the protective cover includes a rigid transparent or translucent member.

12. The apparatus of claim 9, wherein the at least one lighting module comprises a sealing ring disposed between the recess portion and the protective cover.

13. The apparatus of claim 9, wherein the protective cover includes a potting compound.

14. The apparatus of claim 1, wherein the at least one lighting module includes an assembly of light emitting diodes and/or fiber optics.

15. A turntable apparatus for a vehicle lift system, comprising:

a) a base including a top surface and an inner side;

b) a turntable movable support surface mounted on the base for supporting wheels of a vehicle supported by the vehicle lift system; and c) at least one lighting module mounted to the top surface of the base, the lighting module extending adjacent the movable support surface generally between the movable support surface and the inner side of the base, the lighting module configured to illuminate an underside region of the vehicle.

16. A vehicle lift system, comprising:

a) a support structure including first and second ends and a length extending between the first and second ends defining a longitudinal direction, and a top surface for supporting wheels of a vehicle supported by the vehicle lift system;

b) a movable support surface associated with the fixed wheels of the vehicle and located towards the first end of the support structure;

c) at least one lighting module mounted to the movable support surface, the lighting module extending generally in the longitudinal direction adjacent the movable support surface generally between the movable support surface and the inner side of the support structure, the lighting module configured to illuminate an underside region of the vehicle;

d) a base including a top surface and an inner side;

e) a second turntable movable support surface mounted on the base for supporting turning wheels of a vehicle supported by the vehicle lift system; and f) at least one second lighting module mounted to the top surface of the base, the second lighting module extending adjacent the second turntable movable support surface generally between the second turntable movable support surface and the inner side of the base, the lighting module configured to illuminate an underside region of the vehicle.

* * * * *